United States Patent [19]

Grether et al.

[11] 4,432,174

[45] Feb. 21, 1984

[54] SELF-SUPPORTING INSULATION ELEMENT

[75] Inventors: Paul Grether, Seuzach; Kurt Brader, Winterthur; Bruno Keller, Zurich, all of Switzerland

[73] Assignee: Sulzer Brothers Limited, Winterthur, Switzerland

[21] Appl. No.: 390,946

[22] Filed: Jun. 22, 1982

[30] Foreign Application Priority Data

Jul. 14, 1981 [CH] Switzerland ..... 4607/81

[51] Int. Cl.³ ..... E04B 1/00

[52] U.S. Cl. ..... 52/222; 52/172; 52/202; 52/789; 156/109; 160/371; 428/34

[58] Field of Search ..... 52/171, 788, 789, 790, 52/222, 202, 172; 428/34, 46; 160/383, 400, 403, 405, DIG. 15; 156/109

[56] References Cited

U.S. PATENT DOCUMENTS

| | | | |
|---|---|---|---|
| 1,988,964 | 1/1935 | Barrows | 52/789 |
| 2,599,410 | 6/1952 | Probst | 160/400 |
| 2,618,333 | 11/1952 | Judd | 160/400 |
| 3,929,186 | 12/1975 | Becker | 52/172 |
| 4,203,264 | 5/1980 | Kiefer et al. | 52/171 |
| 4,333,284 | 6/1982 | Meadows | 52/222 |

FOREIGN PATENT DOCUMENTS

| | | | |
|---|---|---|---|
| 601592 | 7/1978 | Switzerland | 52/222 |
| 2011985 | 1/1979 | United Kingdom | 52/788 |
| 2051914 | 1/1981 | United Kingdom | 52/222 |

*Primary Examiner*—Alfred C. Perham
*Assistant Examiner*—Mark J. Sofia
*Attorney, Agent, or Firm*—Kenyon & Kenyon

[57] ABSTRACT

A single foil is biaxially stretched on a frame for movement relative thereto by being secured intermittently to a single rubbing strip over a guide ledge. The rubbing strip is stretchable and movable lengthwise of the associated frame side. Torsional forces arising because of the one-sided loading of the frame by the stretched foil are taken up by the frame which is made with a torsionally rigid cross-section.

The single foil can be clamped without creasing and in a manner which ensures freedom from creasing notwithstanding differences in the heat expansion of the foil and frame.

10 Claims, 6 Drawing Figures

Fig. 3
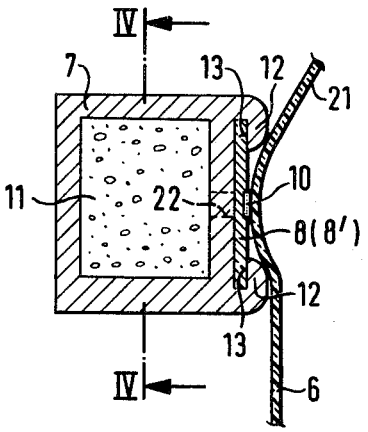
Fig. 5
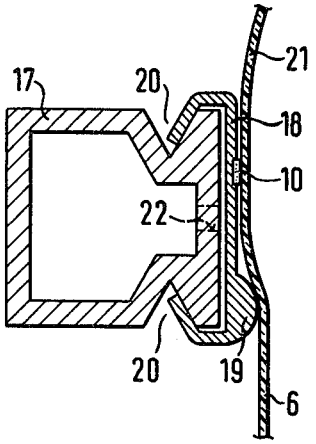
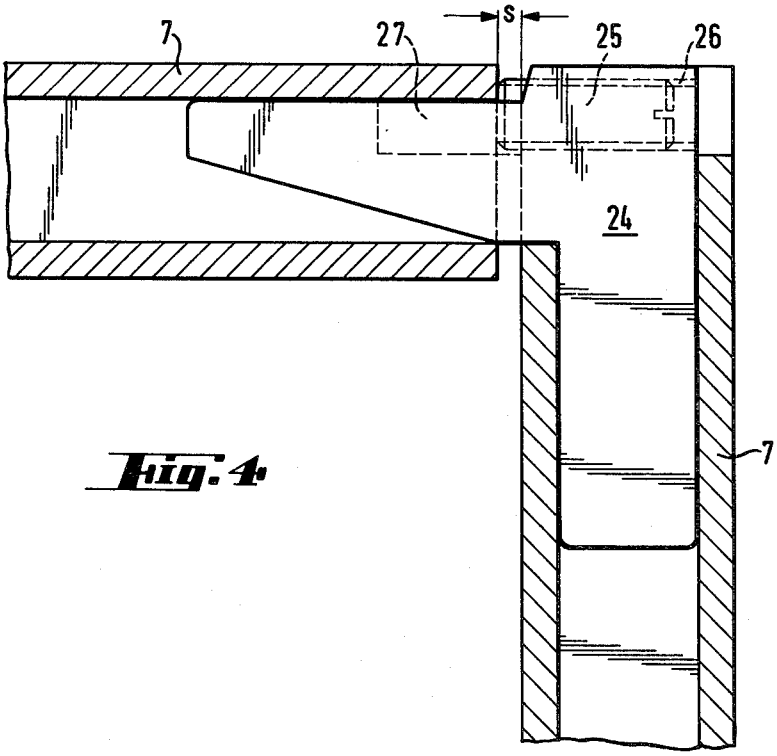
Fig. 4

SELF-SUPPORTING INSULATION ELEMENT

This invention relates to a self-supporting insulation element. More particularly, this invention relates to a self-supporting insulation element for fitting within a double-paned window.

As is known, various types of double-paned or sandwich windows have been constructed with insulating elements between the window panes. For example, German OS No. 2 850 749 describes a window of conventional rectangular or square shape which is provided with an insulation element constructed of a pair of interconnected foils which are stretched over a frame. The frame is constructed so that the individual side pieces are bent in a continuously curved manner, preferably, in the shape of a uniformly loaded unclamped beam. When the foils are stretched over the frame, the sides of the frame are tensioned towards a flattened condition. Because of the biasing action of the frame sides, the foils are biaxially stretched.

Because every additional foil causes absorption and reflection losses in the visible spectral range and reduces optical sharpness and clearness of view and since a single stretched foil, particularly a coated foil, can provide very high heat insulation values, attempts are being directed towards the use of just a single biaxially stretched foil in double-paned windows.

It has also been known that the clamping forces used to clamp foils in place for use in windows must on no account be excessive or too small. Excessive clamping forces damage the coating on coated foils and, thus, leave places which are very susceptible to corrosion. Clamping forces which are too low permit the foil to crease. For example, at room temperature, i.e., at about 20° C., the clamping forces need to be about 1 N per lineal centimeter. Further, the appropriate clamping forces must be insured over a temperature range of from about −20° C. to +50° C.

Still further, one of the requirements of the insulation elements is that the element be self-supporting in order to insure that the reaction forces of foil clamping in a sandwich window do not have to be taken up by an edge joint which is otherwise air tight and water/vapor tight. As such, the joints are very sensitive.

Accordingly, it is an object of the invention to provide an insulation element for a double-paned window which uses only a single biaxially stretched foil.

It is another object of the invention to provide an insulation element for a double-paned window which is self-supporting.

It is another object of the invention to provide a self-supporting insulation element which can be installed in existing double-paned windows.

It is another object of the invention to provide an insulation element in which a foil cannot move longitudinally relative to a frame as a result of differences in heat expansion.

Briefly, the invention provides a self-supporting insulation element for a double-paned window or the like which is comprised of a frame which is constructed of a torsionally rigid section member having a guide ledge on one side, at least one longitudinally expansive rubbing strip disposed in the guide ledge for movement relative to the frame, a single coated foil which is biaxially stretched over the frame in a given plane and a plurality of spots which connect the foil to the strip in offset relation to the plane towards the frame.

The frame is made up of a plurality of sides each of which is bent in a curved manner in an unclamped position of the foil. In addition, each side is made of a hollow section member while a plurality of corner members are provided to interconnect the hollow section members. In this regard, the corner members are engaged in and between two adjacent hollow section members in order to permit perpendicular movement between the hollow section members.

The rubbing strip may be formed of a plurality of separate elements each of which has at least one spot connected thereto. The spots are arranged coaxially along a longitudinal axis with the first and last spots being aligned coaxially with a hollow section member disposed perpendicularly of the longitudinal axis.

The foil is sized to overlap the frame outwardly beyond the spots, i.e., the foil has a peripheral portion which extends outwardly of the frame.

The spots may be made by welding or by adhesive spots.

The construction of the element is such that the foil is rigidly connected only to the rubbing strips. Hence, heat expansions of the foil and the frame may readily differ from one another. Since the one-sided arrangement of the foil leads to asymmetric forces acting on the frame, the frame experiences torsion. However, the torsional rigidity of the frame opposes the torsional load thereon and obviates any disturbing distortion of the cross section of the frame.

The longitudinally expansive nature of the rubbing strip which is insured by separation into separate discrete elements acts in cooperation with the separate connection spots to insure that when the curved frame is clamped, the clamping forces acting on the foil are rendered uniform over the whole length of a frame side.

The use of separate connection spots in the foil would normally cause local disturbances which, in turn, would cause small "micro" distorsions and creases. However, the effect of such faults on the stretched foil in the visible range is obviated by the offsetting of these spots away from the plane of the clamped foil. In this regard, the guide ledge provides a continuous projection over which the foil can be passed for offsetting the connection spots.

In order to discover the "correct" clamping forces, that is, the clamping forces which are neither excessive or too small, the curvature of the unclamped frame sides can be found by calculation or experiment as related to the "straight" frame when clamped. The self-supporting feature of the insulation element is insured by the strength of the clamped frame which is closed on itself.

Advantageously, the torsional rigidity of the frame can be achieved by using closed hollow section members. In this regard, use can be made of the usual metals which are conventional in the window art. Furthermore, fiber reinforced plastic frames with or without metal inserts may also be used.

The overlapping of the foil about the frame obviates or, at least makes difficult, flows around the outside of the element between the frame and a window boundary when used in a sandwich or double-paned window.

The use of the corner members not only provides a simple means of clamping the frame but also permits interception of the torsional loading of the frame at the frame corners. Advantageously, the positioning of the connection spots in the manner described above permits the clamping forces to act at the corners substantially perpendicularly or parallel to the connection spots of the foil and the rubbing strips so as to reduce the risk of creasing.

Conveniently, the foil is connected to the rubbing strip, which may be made of plastic material, with the strip positioned within a preloaded frame.

These and other objects and advantages of the invention will become more apparent from the following detailed description taken in conjunction with accompanying drawings wherein FIG. 1 illustrates a partial front view of a double-paned window having an insulation element installed therein in accordance with the invention;

FIG. 3 illustrates an enlarged detail of FIG. 2;

FIG. 4 illustrates a view taken on line IV—IV of FIG. 3;

FIG. 5 illustrates a view similar to FIG. 3 of a modified frame section member.

Figure 2:
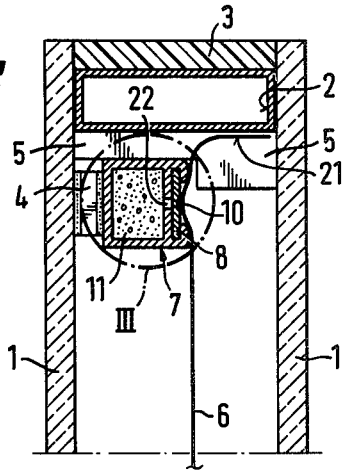
FIG. 2 illustrates a view taken on line II—II of FIG. 1.
Figure 1:
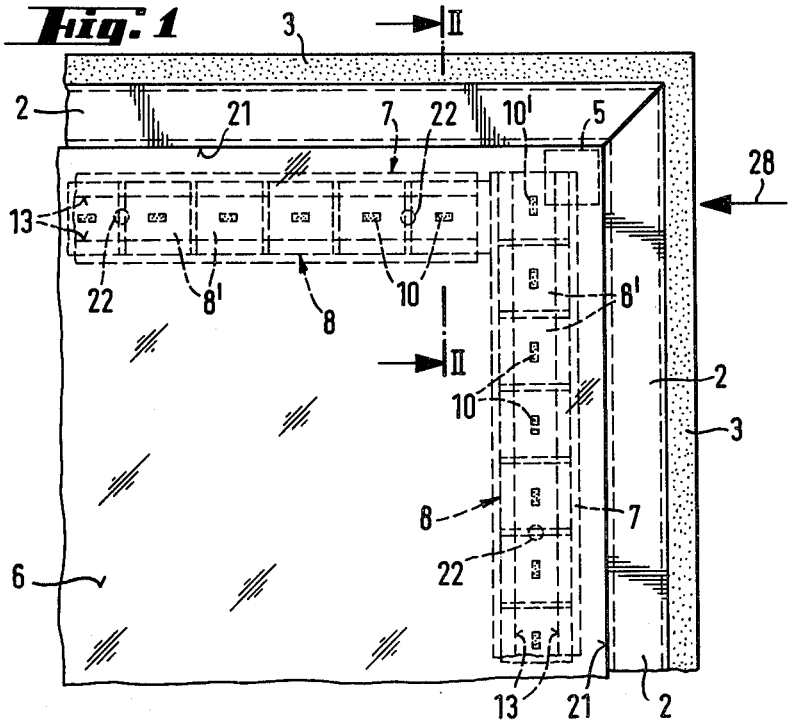

Referring to FIGS. 1 and 2, a double-paned or sandwich window is constructed with a pair of glass panes 1 which are secured to a hollow metal frame 2 by means of a butyl adhesive in air tight and water/vapor tight manner. In addition, a waterproof and load bearing seal 3, for example of a silicone or polysulphide polymer extends about the metal frame 2 between the panes 1.

In addition, a self-supporting insulation element is received between the panes 1 between a distance piece 4 and corner spacer 5. The insulation element is constructed of a single foil 6 and rectangular frame 7 over which the foil 6 is biaxially stretched.

The foil 6 has a coating, for example, of a metal such as gold or silver which is applied in known manner. The coating is characterized in being able to transmit light in the visible spectral range and of being highly reflective in the infrared range.

As indicated in FIG. 2, the spacers 5 are each disposed in the corner of the window frame 2 and are formed with a recess in a corner to receive the insulation element frame 7. The distant pieces 4 are distributed over the longer side of the insulation element frame 7 on the side opposite the foil 6 and are secured in place by an adhesive or a glue.

Referring to FIG. 3, the frame 7 is formed of a plurality of closed hollow section members each of which has a guide ledge or rail 13 on one side. Each element is of square cross section and is produced, for example by extrusion. Advantageously, the hollow interior of each section member is filled with a commercially available physical or chemical siccative 11. Suitable bores 22 are also provided in the walls of the section members, preferably on the side carrying the ledge 13 so that the siccative and the volume of gas to be dried within the window communicate with one another. The guide ledge 13 can be formed by bending over extended edges 12 of the section member.

Figure 6:
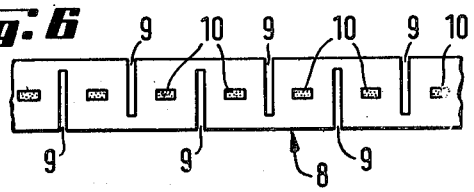
FIG. 6 illustrates a modified rubbing strip in accordance with the invention.

As indicated, a rubbing strip is disposed in the guide ledge 13 of each hollow section member. In this regard, the rubbing strip is made of a plurality of discrete rubbing elements 8′ so as to be longitudinally expansive for movement relative to the hollow section members of the frame 7. As shown in FIG. 6, the strip 8 may also be a unitary member which can be adapted for longitudinal expansion by being formed with spaced apart incisions 9 which extend alternately from both edges. In either construction, the rubbing strip or elements can be made of plastic material.

As indicated, the coated foil 6 is connected to the strip 8 or elements 8′ by discrete interrupted connection spots 10, for example by discrete welding or adhesive spots. Further, these spots 10 are located in a plane which is offset from a main portion of the foil 6 in a direction towards the frame 7. In addition, the foil 6 has a peripheral section which extends outwardly of the frame 7 beyond the spots 10 to form loose flaps 21. When the insulation element is fitted into a window, the flaps 21 engage with the hollow frame 2 (See FIG. 1) and thus prevent circulation of air externally around the frame 7 between the two window chambers which are separated from one another by the insulation element.

Referring to FIG. 4, the sides of the frame 7 which extend perpendicularly to one another are connected by corner members 24 of appropriate cross section. Each corner member 24 is engaged in and between the two adjacent section members in order to permit perpendicular movement between the section members. In this respect, each corner member 24 is of L-shape with one leg clamped to one side member while the other leg is slidably mounted within an adjacent section member. In addition, a tapped bore 26 is formed in the corner member in parallel to the leg which forms the "slideway" for a hollow section member and receives a threaded screw 25. The tapped bore 26 merges into an untapped open partial shell 27 which extends into the slideway leg. As indicated in FIG. 4, the screw 25 can be threaded into abutment against the end of a hollow section member such that upon continued threading of the screw 25 into the tapped bore 26, the two hollow section members move away from each other to define a gap S therebetween during clamping of the foil 6 to the frame 7.

Of note, the gaps S which are formed between the hollow section members of the frame 7 are covered over by the foil 6 as indicated in FIG. 1.

The corner members 24 which are inserted in the section members of the frame 7 also receive the torsional forces which are produced as a result of the one-sided loading of the frame 7 and which act on each sides of the frame 7.

In order to insure that the tension which is operative lengthwise of the foil 6 during clamping of the frame 7 acts as far as possible externally on the edge and as near as possible in parallel thereto, i.e., substantially longitudinally, the rubbing strips 8, 8′ are so disposed at the corners that, as shown in FIG. 1, the line of action of the clamping forces (as indicated by the arrow 28) at every corner extends perpendicularly to the connection spot plane of the borne side. Advantageously, the line of action passes through the end connection spot 10′ and substantially coaxially along a longitudinal axis defined by the intermediate spots 10.

The invention thus provides a self-supporting insulation element which utilizes a single foil and which can be readily assembled. In addition, the insulation element can be readily positioned within a double-paned window. In this respect, the peripheral portion of the foil can be turned so as to provide a seal against the passage of air or vapor from one side of the element to the other side while within the window.

Further, connecting the foil 6 to the frame 7 in an offset manner reduces the chances that small micro-distortions and creases can occur within the foil in the visible spectral range.

What is claimed is:

1. A self-supporting insulation element for a double-paned window, said element comprising a frame consisting of a torsionally rigid section member having a guide ledge on one side;

at least one longitudinally expansive rubbing strip disposed in said guide ledge for movement relative to said frame;

a single coated foil coaxially stretched over said frame in a plane; and a plurality of spots connecting said foil to said strip in offset relation to said plane towards said frame.

2. A self-supporting insulation element as set forth in claim 1 wherein said frame has a plurality of sides, each said side being bent in a curved manner in an unclamped position of said foil.

3. A self-supporting insulation element as set forth in claim 1 wherein said strip includes a plurality of separate elements each having at least one spot connected thereto.

4. A self-supporting insulation element as set forth in claim 1 wherein said frame is a peripherally closed hollow section member.

5. A self-supporting insulation element as set forth in claim 1 wherein said foil overlaps said frame outwardly beyond said spots.

6. A self-supporting insulation element as set forth in claim 1 wherein said frame includes a plurality of hollow section members and corner members, each corner member being engaged in and between two adjacent section members to permit perpendicular movement between said section members.

7. A self-supporting insulation element as set forth in claim 6 wherein movement of one of said adjacent sections relative to the other of said adjacent sections occurs coaxially with a spot at one end of said one section and coaxially along longitudinal axis of said spots.

8. A self-supporting insulation element for a double-paned window, said element comprising a torsionally rigid frame having a plurality of sides, each said side having a guide extending longitudinally thereof;

a plurality of rubbing strips, each said strip being disposed within a respective guide for relative longitudinal movement;

a single coated foil biaxially stretched over said frame with a main portion disposed in a single plane between said sides; and a plurality of spots connecting said foil to said sides on one face of said frame in offset relation to said plane towards said frame.

9. A self-supporting insulation element as set forth in claim 8 wherein said foil has a peripheral portion extending outwardly of said frame.

10. A self-supporting insulation element as set forth in claim 8 wherein said spots are adhesive spots.

* * * * *

UNITED STATES PATENT AND TRADEMARK OFFICE

CERTIFICATE OF CORRECTION

PATENT NO. : 4,432,174

DATED : February 21, 1984

INVENTOR(S) : Paul Grether, et al.

It is certified that error appears in the above-identified patent and that said Letters Patent is hereby corrected as shown below:

Column 5, line 8, "coaxially" should read -- biaxially --.

Signed and Sealed this

*Twenty-sixth* Day of *March 1985*

[SEAL]

*Attest:*

DONALD J. QUIGG

*Attesting Officer*

*Acting Commissioner of Patents and Trademarks*